US008578951B2

(12) United States Patent
Bohac et al.

(10) Patent No.: US 8,578,951 B2
(45) Date of Patent: Nov. 12, 2013

(54) DISHWASHER WITH CONDUCTIVITY MEASUREMENT

(75) Inventors: Jiri Bohac, Erlangen (DE); Rolf Stahlmann, Wolframs-Eschenbach (DE); Hansjörg Lampe, Nürnberg (DE)

(73) Assignee: Electrolux Home Products Corporation, N.V., Zaventem (BE)

( * ) Notice: Subject to any disclaimer, the term of this patent is extended or adjusted under 35 U.S.C. 154(b) by 797 days.

(21) Appl. No.: 12/741,008

(22) PCT Filed: Oct. 10, 2008

(86) PCT No.: PCT/EP2008/008572
§ 371 (c)(1),
(2), (4) Date: Apr. 30, 2010

(87) PCT Pub. No.: WO2009/059676
PCT Pub. Date: May 14, 2009

(65) Prior Publication Data

US 2010/0300501 A1 Dec. 2, 2010

(30) Foreign Application Priority Data

Nov. 7, 2007 (EP) ..... 07021609

(51) Int. Cl.
*B08B 3/00* (2006.01)
*B08B 3/12* (2006.01)
*B08B 6/00* (2006.01)

(52) U.S. Cl.
USPC ..... 134/113; 134/56 D; 134/57 D; 134/58 D; 134/198

(58) Field of Classification Search
USPC ..... 134/56 D, 57 D, 58 D, 113, 198
See application file for complete search history.

(56) References Cited

U.S. PATENT DOCUMENTS 3,223,108 A 12/1965 Martz, Jr.
4,211,517 A 7/1980 Schmid (Continued)

FOREIGN PATENT DOCUMENTS

DE 296 11 091 U1 12/1997
DE 196 50 915 A1 1/1998

(Continued)

OTHER PUBLICATIONS

Official Decision of Grant for Russian Application No. 2010122948/12 dated Mar. 1, 2011.

(Continued)

*Primary Examiner* — Michael Barr
*Assistant Examiner* — Charles W Kling
(74) *Attorney, Agent, or Firm* — Alston & Bird LLP

(57) ABSTRACT

A dish washer comprises a washing tub having a sump, at least one spraying nozzle located within the washing tub, means for feeding fresh water into the sump, a circulation pump for circulating process water from the sump to the spraying nozzle and a conductivity sensor for measuring the conductivity of the fresh and/or the process water. In order to enable use of a single conductivity sensor for measuring the conductivity of both the fresh and the process water, the conductivity sensor is located in a conduit for feeding fresh water into the sump and there further is provided a bypass line which is arranged to cause process water to flow through the conductivity sensor when the circulation pump is in operation.

9 Claims, 3 Drawing Sheets

(56) References Cited

U.S. PATENT DOCUMENTS

| | | | | |
|---|---|---|---|---|
| 4,227,151 | A | 10/1980 | Ellis et al. | |
| 6,223,129 | B1 * | 4/2001 | Chan et al. | 702/30 |
| 2003/0213505 | A1 * | 11/2003 | Price et al. | 134/25.2 |
| 2005/0174123 | A1 | 8/2005 | Ott | |

FOREIGN PATENT DOCUMENTS

| | | | |
|---|---|---|---|
| EP | 0 633 342 | | 1/1995 |
| EP | 0 686 721 | | 12/1995 |
| EP | 1 688 529 | | 8/2006 |
| GB | 2 266 898 | | 11/1993 |
| RU | 1789191 | A1 | 1/1993 |
| WO | WO 99/58990 | | 11/1999 |

OTHER PUBLICATIONS

International Search Report for International Application No. PCT/EP2008/008572.

* cited by examiner

DISHWASHER WITH CONDUCTIVITY MEASUREMENT

BACKGROUND OF THE INVENTION

1. Field of the Invention

The present invention relates to a dishwasher comprising a washing tub having a sump, at least one spraying nozzle located within the washing tub, means for feeding fresh water into the sump, a circulation pump for circulating process water from the sump to the spraying nozzle, and a conductivity sensor for measuring the conductivity of the fresh and/or the process water.

2. Description of Related Art

Such a dishwasher is known from U.S. Pat. No. 4,211,517, which discloses a commercial dishwasher that it provided with a conductivity sensor that is located in the sump and which is used to measure the pH-level in the sump so as to control the supply of detergent during a washing cycle. The dishwasher disclosed in U.S. Pat. No. 4,211,517 is disadvantageous, because it only allows to measure the conductivity of the process water. Measurements of the conductivity of the fresh water, which could be used to determine the water hardness or to provide for a calibration of the set-point level of the conductivity to be achieved, are not possible.

In order to overcome such problems, it was suggested in EP 0 686 721 B1 for a washing machine to provide, in addition to a first conductivity sensor that is arranged in the sump of the washing tub and which is used to measure the conductivity of the process water, a second conductivity sensor that is provided in the water inlet line. While in this manner it is possible to measure both the conductivity of the fresh water and of the process water, the solution provided for in EP 0 686 721 B1 has the disadvantage that it requires the provision of two conductivity sensors, which thus adds to the complexity and costs of the system.

Furthermore, from EP 1 688 529 A1 there is known a washing machine having a water intake, which is connected to a detergent drawer that is located at the top of the washing machine so as to be above the water level within the washing tub. When the water intake is activated, washing powder that has been provided within the detergent drawer is flushed out and is passed via a conduit into a washing drum, which can be rotated within the tub. In order to be able to evaluate whether the washing powder has been completely flushed out of the detergent drawer into the washing tub, the conduit leading from the detergent drawer to the washing tub is equipped with a conductivity sensor and with a turbidity sensor. During rinsing the washing powder out from the detergent drawer both the conductivity sensor and the turbidity sensor continuously provide a measuring signal, which signals during flushing the detergent drawer change until the washing power has been completely flushed out of the detergent drawer. While thus EP 1 688 529 A 1 employs the conductivity sensor solely to detect whether the conductivity changes, in this arrangement it is not possible to qualitatively measure the conductivity of the freshwater or the process water, since the water flowing through the conductivity sensor in any event has to pass the detergent drawer, which at any time of the measurement may contain an unknown amount of washing powder.

SUMMARY OF VARIOUS EMBODIMENTS

It is an object of the invention to provide a dishwasher as it is defined in the pre-characterizing portion of claim 1, which allows measurement of the conductivity both of the freshwater and of the process water, which dishwasher is less complicated and hence easier to manufacture and operate than prior art dishwashers.

In accordance with the present invention this object is solved by providing a single conductivity sensor which is located in a conduit for feeding fresh water into the sump and by further providing a bypass line which is arranged to cause process water to flow through the conductivity sensor when the circulation pump is in operation. In this manner the conductivity sensor can be used on the one hand to measure fresh water that is fed into the sump and which has not yet come into contact with process water that already is contained within the tub and which thus may contain detergent and/or pollutants that were washed-off from articles that have been placed into the washing tub. On the other hand, during a regular washing cycle during which the fresh water feed in shut off and instead the circulation pump is in operation, i.e. feeds water from the sump to the spraying nozzles located within the washing tub, process water is fed through the conductivity sensor by means of the bypass line, so that the conductivity of the process water can be determined. The present invention thus obviates the necessity to provide for two conductivity sensors for measuring the conductivity of the fresh water and for measuring the conductivity of the process water, and thus reduces both the complexity and the manufacturing costs of the dishwasher.

Preferred embodiments of the present invention are defined in the dependent claims.

In particular, the conductivity sensor preferably is located close to the sump and advantageously is located at a level that is below the regular filling level of the sump during operation of the dishwasher; i.e. below the level to which the sump is filled with water during operation of the dishwasher except the times when the sump is drained. In this manner process water can be drawn from the sump through the conductivity sensor solely by making use of the pressure conditions prevailing within the sump due to the action of the circulation pump.

Preferably, the conductivity sensor is located at a level within the sump, i.e. at a level below the regular filling level of the sump, but above the level of the floor of the sump, so that by draining the sump also the conductivity sensor may be drained.

In a preferred embodiment of the invention the bypass line at one end is connected to a line downstream of the circulation pump and at its other end joins the conduit through which freshwater is fed into the sump, wherein the conductivity sensor is located in the said conduit at a location between its joint with the bypass line and the point where the conduit feeds water into the sump. In this embodiment, when fresh water is fed into the dishwasher, the fresh water flows through the conduit for feeding fresh water into the sump. Since the conductivity sensor is located in this conduit, a measurement of the conductivity of the fresh water may be taken. While the fresh water that is sent to the sump has to pass the joint of the conduit and the bypass line, a portion of the fresh water will flow through the bypass line and thus will be distributed to the spray nozzles. Should it be preferred to pass the entire fresh water into the sump, the bypass line could be provided with a valve, so as to shut-off the bypass line during feeding fresh water into the dishwasher.

The valve in the bypass line could be for example an electromagnetic valve that is operated by the central controller of the dish washer which also controls other components of the machine, such as the water intake, the circulation pump etc. In such embodiments the system could be designed such that the valve opens only at times when a conductivity measurement shall be made, but else during circulating process water through the dish washer is kept closed. The opening and closing of the valve in the bypass line also could be made dependent on the operation of the spray arms. For example, the valve could be opened only when a specific spray arm is in operation, or it could be closed if more water should be fed to a certain spray arm.

Furthermore, the valve in the bypass line could also be designed to operate or to be operated in dependency of the pressure within the bypass line. Thus, in case that the spray arms shall be fed with water at a higher pressure, this could be effected by operating the circulation pump at a higher speed which results in a higher pressure at the pump exit and hence also within the bypass line. When due to such higher pressure the valve within the bypass line closes, all water that is pumped by the circulation pump will be fed to the spray arms. In embodiments where the valve within the bypass line is designed as a flow controller, the amount of water that is passed through the bypass line could be regulated such that the flow through the conductivity sensor is kept substantially constant.

In other embodiments, the valve in the bypass line also could be a one-directional pressure actuated valve, such as a flap valve made of a resilient material such as rubber, which allows water to flow through only in one direction.

When a washing cycle is carried-out, i.e. when the fresh water inlet is closed and the circulation pump is operating, the circulation pump draws water from the sump and feeds it to the spraying nozzles. In such a situation a portion of the water that is pumped by the circulation pump will pass through the bypass line and, upon reaching the joint with the conduit for feeding fresh water into the sump, will flow towards the sump and thus will flow through the conductivity sensor. Should it be preferred not to measure conductivity of the process water over the entire washing cycle, but instead feed the entire process water which passes the circulation pump to the spraying nozzles, again a valve could be provided within the bypass line, so as to shut-off the connection between the line downstream the circulation pump and the fresh water feed conduit.

In order to be able to completely empty the conductivity sensor when the sump is drained, the conduit may be provided with a downward slope towards the sump in the region where the conductivity sensor is located. By emptying the sensor it can be avoided that dirt particles and the like build up on the conductivity sensor. Furthermore, by venting the conduit and thus the conductivity sensor, the sensor can be calibrated in air so as to prevent inaccurate measurements of the inlet and/or process water.

The accuracy of the conductivity measurement can be further improved by providing for an operating sequence in which, prior to a measurement, the feed of water through the conductivity sensor is interrupted, so that the water within the conductivity sensor can settle so as to allow gas bubbles which have formed during pumping or circulation of the water can escape. Furthermore, the operating sequence may include steps for draining, venting and/or flushing the conductivity sensor.

In an alternative preferred embodiment the bypass line at one end opens into the sump at a location from which, during operation of the circulation pump, water is drawn out of the sump, wherein the bypass line with its other end joins the said conduit, and wherein the conductivity sensor is located in the conduit at a location between its joint with the bypass line and the point where the conduit feeds water into the sump. In this embodiment the fresh water that is fed into the sump is divided into two portions, wherein one portion of the fresh water is passed into the sump at a location close to the point where the circulation pump withdraws water from the sump, and a second fresh water portion that is passed into the sump at a location that is remote from the suction point of the circulation pump. With the conductivity sensor being placed downstream of the joint, where the fresh water is divided into the said two portions, during water inlet, i.e. when water flows through both branches, one of which being equipped with the conductivity sensor, a measurement of the conductivity of the fresh water can be taken. On the other hand, when the circulation pump is in operation and no fresh water is fed into the dishwasher, a flow through the bypass line will be caused due to the different pressures that prevail in the two regions into which the feed conduit and the bypass line open into the sump. Thus, there will be a flow of process water into the line which opens into the sump remote from the suction point of the circulation pump, which flow will continue to the joint and through the second feed conduit which opens to the sump close to the suction point of the circulation pump. With the conductivity sensor being located between the joint and the point where the respective conduits opens into the sump, process water thus will flow through the conductivity sensor, which thus allows to measure the conductivity of the process water so as to evaluate the process water in terms of concentration of detergent, degree of soiling etc.

Preferably, also in this embodiment measures are taken to enable complete draining of the conductivity sensor, such as by providing the bypass line with a downward slope towards the sump so that upon draining the sump also the conductivity sensor will be completely drained.

BRIEF DESCRIPTION OF THE SEVERAL VIEWS OF THE DRAWINGS

Preferred embodiments of the invention will be described below by reference to the drawings, in which.

DETAILED DESCRIPTION

Figure 1:
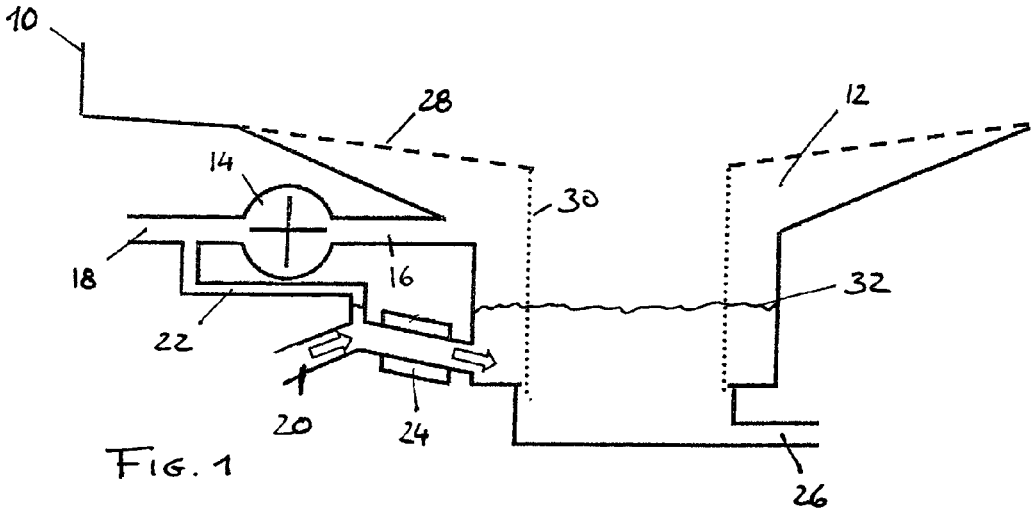
FIG. 1 is a schematic illustration of the lower section of a dishwasher and in particular of the sump of the washing tub, wherein arrows indicate the water flow during feeding fresh water into the sump.

In FIG. 1 there is shown the lower section of the washing tub 10 of a dishwasher, which washing tub may be equipped with one or more trays to hold articles to be cleaned as well as spraying nozzles that in the conventional manner may be provided on rotating spray arms mounted below and above the said trays and by which water jets may be directed onto the articles to be washed. In the bottom of the washing tub there is a sump 12, in which water that has been sprayed onto the articles to be washed collects, so as to be recycled to the spraying nozzles by means of a recirculation pump 14 feeding the rotating spray arms which as such are not shown in the drawings. To this end, the inlet of circulation pump 14 is connected to a suction tube 16 the other end of which opens into sump 12. At the outlet side of the circulation pump 14 there is connected a conduit 18 for feeding process water to the rotating spray arms. In order to feed fresh water into the sump 12 there is provided a conduit 20 which is connected to a water supply (not shown), such as a valve-controlled inlet line to be connected to a domestic water line. A bypass line 22 connects the fresh water feed conduit 20 and the conduit 18 for feeding process water to the spray arms. In the region of conduit 20 between its joint to the bypass line 22 and the point where it opens into sump 12 there is provided a conductivity sensor 24, which provides for a reading of the conductivity of any water that is passed through conduit 20.

At the bottom of sump 12 there is provided a drain pipe 26 for draining the sump 12. As it is shown in FIG. 1 the bottom of tub 10 is generally funnel-shaped and in its central region merges into sump 12, so that process water, which has been sprayed onto the articles to be washed and which drops down therefrom or flows downward along the walls of the tub is guided towards the central region and collects in sump 12. At the interface between tub 10 and sump 12 there is provided a flat filter 28 which in its central portion merges into a dirt trap comprising a filter element 30 to remove dirt particles from the water which the circulation pump 14 circulates to the spraying nozzles.

In the following, by reference to FIGS. 1 and 2, the operation of the dishwasher will be described. Upon start-up of the machine fresh water is passed into the dishwasher. To this end fresh water is fed via conduit 20 into the sump 12 until the water level within the sump which in FIG. 1 is designated as 32 rises above the level where suction tube 16 opens into the sump. During filling of sump 12 the drain pipe 26 is closed and the circulation pump 14 is inoperative. During feeding fresh water into the dishwasher the conductivity of the freshwater can be determined by means of the conductivity sensor 24.

When sufficient fresh water has been fed into the dishwasher, the fresh water feed into conduit 20 is terminated and the washing cycle is started by operating circulation pump 14, which draws water from sump 12 and feeds it via conduit 18 to the spraying nozzles arranged within the washing tub 10. When process water is fed by circulation pump 14 into conduit 18, a portion of such process water will be diverted into bypass line 22 and thus will flow into conduit 20. Since the fresh water inlet is closed, the process water will flow in conduit 20 towards the sump 12, thus passing conductivity sensor 24, so that a reading of the conductivity of the process water can be taken. In this manner, conductivity sensor 24 can be used to measure both the conductivity of the fresh water that is fed into the dish washer as well as of the process water that is circulated within the dishwasher.

While for measuring the conductivity of the fresh water or of the process water a water level within the dish washer should be selected such that the conductivity sensor 24 is completely filled with water, it should be noted that at times during the washing cycle when no conductivity measurements are to be made the water level may be lower.

Figure 2:
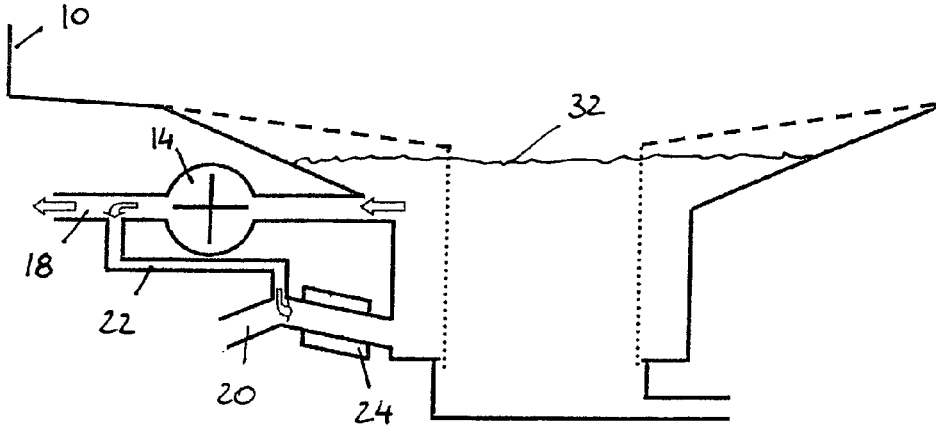
FIG. 2 is a view similar to FIG. 1, illustrating the flow of process water during operation of the circulation pump.

As shown in FIGS. 1 and 2 the conductivity sensor 24 preferably is located close to the sump so that the portion of conduit 20 between its joint to bypass line 22 and its opening into sump 12 can be designed as a short piece of tubing so that upon switching between the fresh water feed mode and the process water circulation mode it takes only a small volume of fresh water or process water, respectively, to displace any process water or fresh water, respectively, that during the previous measurement was present in the region of the conductivity sensor 24. Thus, the measurements of the conductivity can be made in a very accurate manner and with only very little delay after a previous measurement.

Should it be preferred that during feeding fresh water into the dishwasher, the entire water that is fed into the machine via conduit 20 is fed into sump 12 and/or should it be preferred that during operation of the circulation pump the entire water is fed to the spraying nozzles, this can be accomplished by providing a shut-off valve within bypass line 22, which valve then would be closed during feeding fresh water into the dish washer and which would be opened during the circulation mode only at times during which the conductivity of the process water is to be measured. Instead of a shut-off valve a flow controller could be located within the bypass line 22 so as to apportion the amount of water that is passed through the bypass line.

Furthermore, it should be noted that the conductivity sensor 24 also could be located within suction tube 16. In such embodiments, during feeding fresh water into the dishwasher, the conductivity sensor 24 will be filled with freshwater that flows through bypass line 22 and backwards through circulation pump 14, which during fresh water intake is inoperative. During the washing or circulation mode, when the circulation pump 14 active, process water is drawn from sump 12 into suction tube 16 and hence into conductivity sensor 24.

Figure 3:
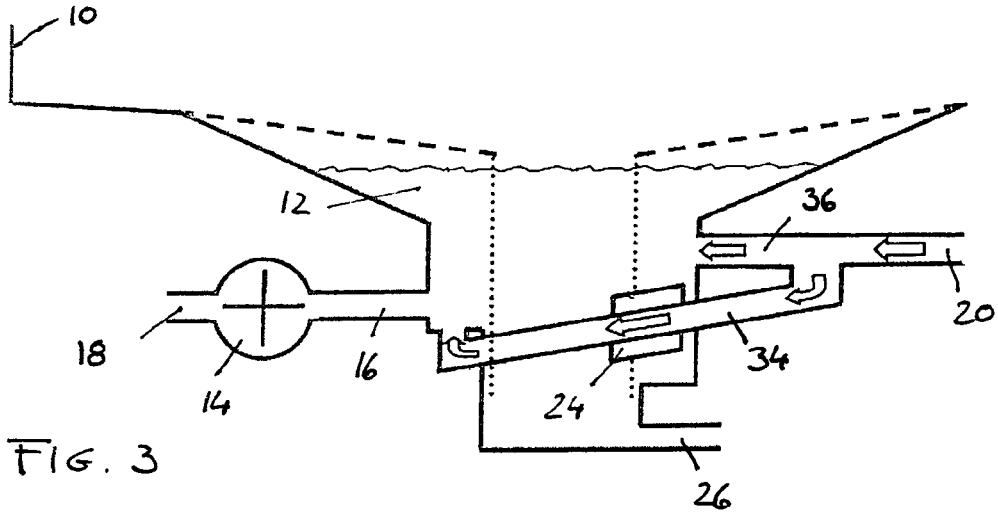
FIG. 3 is a schematic drawing similar to FIG. 1 of a further embodiment of a dishwasher made in accordance with the present invention indicating the flow of fresh water into the sump.
Figure 4:
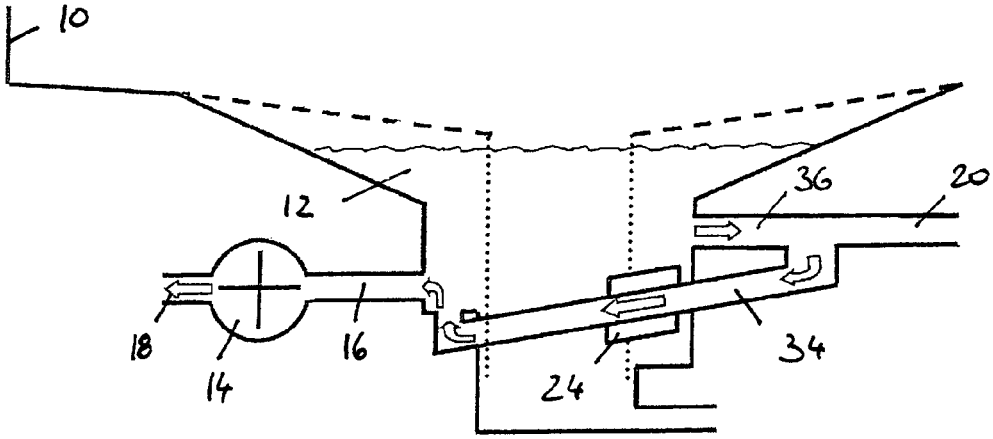
FIG. 4 illustrates the flow of process water when in the dishwasher illustrated in FIG. 3 the water inlet is closed and the circulation pump is in operation.

In FIGS. 3 and 4 there is shown a further embodiment of a dishwasher made in accordance with the present invention, wherein an alternative arrangement for employing a single conductivity sensor for measuring conductivity of both the fresh water and the process water is implemented. In the embodiment shown in FIGS. 3 and 4 again a bypass line 34 is connected to the fresh water feed line 20. However, in the embodiment shown in FIGS. 3 and 4 the bypass line is not connected to the downstream side of the circulation pump 14, but rather opens into the sump at a location from which during operation of the circulation pump 14 water is drawn out from the sump. As shown in FIGS. 3 and 4, bypass line 34 may be connected to the sump so as to open into the sump at a location close to the location where suction tube 16 opens into the sump. In contrast thereto fresh water feed conduit 20 opens into the sump 12 at a location that is remote from the location where suction tube 16 opens into the sump.

During feeding fresh water into the dishwasher the fresh water in conduit 20 thus is divided into a first portion, which continues to flow in conduit 20 also after the point where the bypass line 34 branches off, so as to be passed through the remainder 36 of conduit 20 into sump 12. A second portion of the fresh water is diverted into bypass line 34 and thus also enters the sump 12. During feeding fresh water through conduit 20 the conductivity of such fresh water can be measured within bypass line 34, where the conductivity sensor 24 is located.

When the required filling level is reached within sump 12 the fresh water intake to line 20 is closed and the circulation pump 14 is put into operation. In this situation, which is illustrated in FIG. 4, due to the pressure difference existing at the points where conduit 20 and bypass line 34 open into the sump, process water is drawn into the end portion 36 of conduit 20 to flow through bypass line 34 thus passing conductivity sensor 24.

Figure 5:
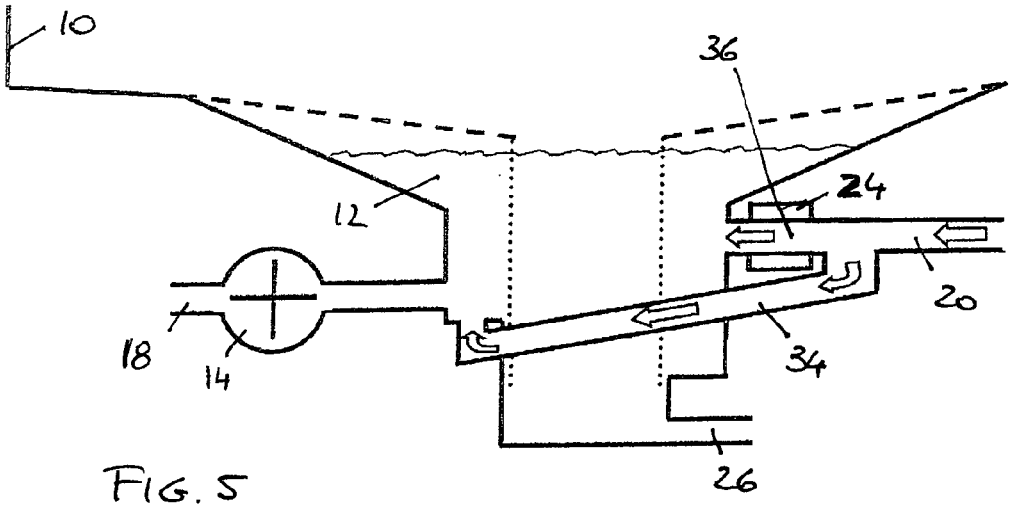
FIG. 5 is an illustration similar to FIG. 3 of a modified embodiment during fresh water feed.
Figure 6:
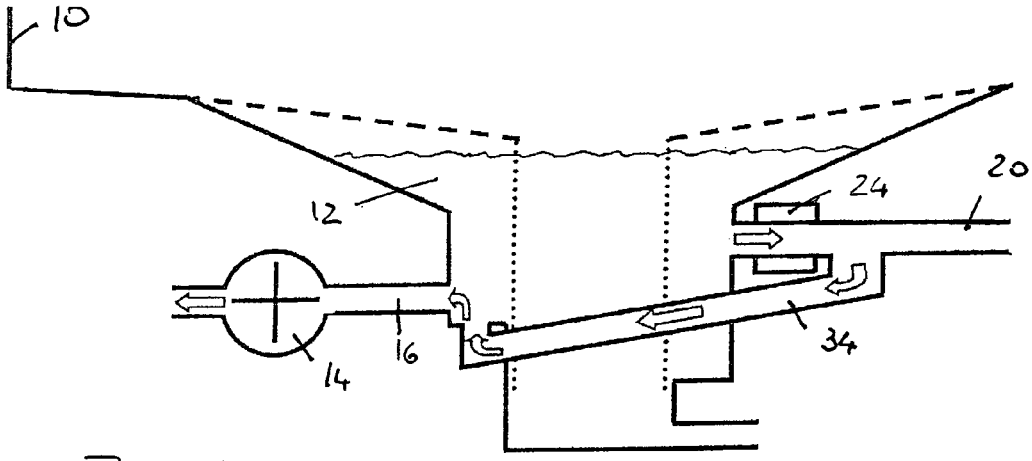
FIG. 6 shows the flow regime of the dishwasher shown in FIG. 5 during operation of the circulation pump.

In FIGS. 5 and 6 there is shown a modified version of the embodiment shown in FIGS. 3 and 4, which differs from the latter embodiment merely in the location where the conductivity sensor 24 is located. Thus, instead of locating the conductivity sensor 24 in bypass line 34, in the embodiment shown in FIGS. 5 and 6 the conductivity sensor 24 is located in portion 36 of conduit 20, i.e. in that portion of the fresh water feed conduit 20 which extends from the location where bypass line 34 connects to conduit 20 and the end of conduit 20 where it opens into the sump.

The operation of the system shown in FIGS. 5 and 6 is identical to that of the embodiment shown in FIGS. 3 and 4. Thus, whereas during feeding fresh water into the dishwasher, a portion of the fresh water passes conductivity sensor 24, during the regular washing mode, i.e. at times when no fresh water is fed via conduit 20 into the dishwasher and the circulation pump 14 is in operation so as to pump process water that is withdrawn from sump 12 via conduit 18 to the spraying nozzles, water is sucked into the end portion 36 of conduit 20 to be delivered into bypass line 34 and back into the sump. On its way through conduits 36 and 34 the process water thus passes conductivity sensor 24, which thus again can be used to measure the conductivity of both fresh water and process water.

Preferably also in the embodiments shown in FIGS. 3 to 6 measures are taken to completely drain the conductivity sensor 24, such as providing the bypass line 34 or end portion 36 of conduit 20 with a slope towards the sump.

The invention claimed is:

1. A dish washer comprising a washing tub having a sump, at least one spraying nozzle located within the washing tub, means for feeding fresh water into the sump, a circulation pump for circulating process water from the sump to the spraying nozzle and a conductivity sensor for measuring the conductivity of the fresh and/or the process water, characterized in that the conductivity sensor is located in a conduit for feeding fresh water into the sump and there further is provided a bypass line which is arranged to cause process water to flow through the conductivity sensor when the circulation pump is in operation.

2. The dish washer of claim 1, wherein the conductivity sensor is located at a level that is below a regular filling level of the sump during operation of the dishwasher.

3. The dish washer of claim 2, wherein the conductivity sensor is located at a level within the sump.

4. The dish washer of claim 1, wherein the bypass line at one end is connected to a line downstream of the circulation pump and at its other end joins the conduit, wherein the conductivity sensor is located in the conduit at a location between its joint with the bypass line and a point where the conduit feeds water into the sump.

5. The dish washer of claim 4, wherein said conduit in a region where the conductivity sensor is located has a downward slope towards the sump.

6. The dish washer of claim 1, wherein the bypass line at one end opens into the sump at a location from which during operation of the circulation pump water is drawn out of the sump, the bypass line with its other end joining the conduit, wherein the conductivity sensor is located in the conduit at a location between its joint with the bypass line and a point where the conduit feeds water into the sump.

7. The dish washer of claim 6, comprising a suction tube through which during operation of the circulation pump water is drawn out of the sump and to the circulation pump, wherein the bypass line opens into the sump at a location close to the point where the suction tube is connected to the sump.

8. The dish washer of claim 1, wherein the bypass line at one end opens into the sump at a location from which during operation of the circulation pump water is drawn out of the sump, the bypass line with its other end joining the conduit, wherein the conductivity sensor is located in the bypass line.

9. The dish washer of claim 8, wherein the bypass line at least in a region of the conductivity sensor has a downward slope towards the sump.

* * * * *